US007036811B2

(12) United States Patent
Howe

(10) Patent No.: US 7,036,811 B2
(45) Date of Patent: May 2, 2006

(54) REGISTRATION SYSTEM PAPER PATH LENGTH COMPENSATION

(75) Inventor: Richard L. Howe, Webster, NY (US)

(73) Assignee: Xerox Corporation, Stamford, CT (US)

( * ) Notice: Subject to any disclaimer, the term of this patent is extended or adjusted under 35 U.S.C. 154(b) by 557 days.

(21) Appl. No.: 10/248,591

(22) Filed: Jan. 30, 2003

(65) Prior Publication Data

US 2004/0150154 A1 Aug. 5, 2004

(51) Int. Cl.

| | |
|---|---|
| ***B65H 5/22*** | (2006.01) |
| ***B65H 83/00*** | (2006.01) |
| ***B65H 85/00*** | (2006.01) |
| ***B65H 5/00*** | (2006.01) |

(52) U.S. Cl. ..... 271/3.13; 271/4.12; 271/4.1; 271/220

(58) Field of Classification Search ..... None
See application file for complete search history.

(56) References Cited

U.S. PATENT DOCUMENTS

| | | | | |
|---|---|---|---|---|
| 4,986,528 | A * | 1/1991 | Watarai et al. | 271/265.01 |
| 5,199,702 | A | 4/1993 | Davis et al. | |
| 5,342,037 | A | 8/1994 | Martin | |
| 5,483,893 | A * | 1/1996 | Isaac et al. | 101/485 |
| 5,519,478 | A | 5/1996 | Malachowski | |
| 5,794,176 | A | 8/1998 | Milillo | |
| 5,983,066 | A * | 11/1999 | Abe et al. | 399/394 |
| 6,029,020 | A * | 2/2000 | Blackman et al. | 399/45 |
| 6,370,354 | B1 * | 4/2002 | Chapman et al. | 399/394 |
| 6,374,075 | B1 | 4/2002 | Benedict et al. | |
| 6,550,759 | B1 * | 4/2003 | Kotaka et al. | 271/10.11 |
| 2002/0017755 | A1 * | 2/2002 | Dobberstein et al. | 271/227 |
| 2003/0112020 | A1 * | 6/2003 | Yankielun et al. | 324/644 |

OTHER PUBLICATIONS

Copending U.S. Appl. No. 10/248,590, filed Jan. 30, 2003, Howe.

* cited by examiner

*Primary Examiner*—Donald P Walsh
*Assistant Examiner*—Kenneth W Bower
(74) *Attorney, Agent, or Firm*—Oliff & Berridge, PLC

(57) ABSTRACT

Systems and methods of registration system control are provided that compensate for differences in physical properties of various substrates being transported through the system that impact the displacement of the substrate through a given path. Exemplary systems of the invention include at least one roll pair formed by a first, driven roll and a second roll defining a nip therebetween that is part of the transport path through which a substrate is passed. A prestored lookup table includes empirically- or theoretically-derived compensation factors for plural different kinds of substrates, with each compensation factor being based on physical characteristics of the substrate that impact actual travel length of the substrate along the transport path, such as the substrate's mass per unit area, which has been found to have a strong correlation with a substrate's bending stiffness, which has been found to have a strong correlation with detected deviations in linear travel path. Upon input or determination of the substrate being registered, the system adjusts the drive profile of the drive roll by the compensation factor. This is preferably by adding the derived paper path length adjusting value to the actual nominal length between the drive roll pair and a desired registration position to take into account an arcuate or non-linear travel path due to flexure of the substrate. A suitable compensation factor compensates for the amount of angular rotation of the drive roll so that the travel path length of the substrate is appropriated compensated.

19 Claims, 8 Drawing Sheets

REGISTRATION SYSTEM PAPER PATH LENGTH COMPENSATION

BACKGROUND OF THE INVENTION

1. Field of Invention

The invention relates to systems and methods for providing a compensation factor for a registration system that takes into account differing physical characteristics of various substrates used in the system. In particular, a compensation factor, such as a theoretically or an empirically derived paper path length adjustment value, is stored for various substrates and used in drive roll control profile computations to provide process direction registration control of the substrates passing through the system.

2. Description of Related Art

There are a variety of transport and registration systems in use that transport and register various substrates, such as copy sheets. In many registration systems, such as those often found in copiers, facsimiles, and printers, drive mechanisms often include at least one driven elastomer-covered roll backed by a hard idler roll to form a roll pair defining a nip region therebetween. A substrate, such as copy paper, provided to the nip region is advanced by rotation of the roll pair, which causes corresponding linear movement of the substrate, such as paper.

High quality documents require registration of sheets to a photoreceptive surface for image transfer. In order to achieve this, accurate registration control is needed to locate the image with respect to the edge of the sheet. Conventional machines use various types of sheet registration devices. Some sense the position of the sheet at a first location and use this sensed information to generate a set of control signals to cause the sheet to arrive at a second location in proper registry. Other systems compute or approximate sheet position Indirectly based on known parameters of the registration system and sensed values of various drive elements.

In most conventional registration systems used for printers, copiers and facsimile machines, the types of substrates being transported usually do not vary much. That is, many systems typically encounter only a limited number of different substrate types, such as basic draft sheet stock of a certain weight in basic sizes such as A4 or 8.5×11 inches. A typical registration system is designed to transport, for example, 20 lb. bond sheet stock (roughly 75 grams/$m^2$ or GSM). Occasionally, higher quality bond paper of a slightly higher weight, such as 24 lb. bond (roughly 90 GSM) or 28 lb. bond (roughly 105 GSM) sheet stock is used. In conventional registration systems, these sheets are transported using the same drive profiles. That is, the drive control parameters are fixed (i.e., set irregardless of the type of sheet being used).

In conventional drive roll systems, angular velocity and degrees of rotation of the driven roll can be readily determined from conventional measurement systems, such as rotary encoders. From this information and knowledge of the roll radius of the drive roll, the system can, through equations, approximate the linear movement of the substrate passing through the nip region. This linear movement, including travel velocity, is relevant because various timing and other position control is based on the determined linear velocity of the substrate. For example, if It is desired that a substrate reach a desired position such as a leading edge transfer position 1000 mm from the drive roll at a given time t, through computation knowing both the distance (1000 mm) and the determined linear velocity (X mm/sec), the time to start the transport can be calculated. Alternatively, or in addition thereto, a desired velocity can be set to match other system components so that the substrate is at a select location at a desired speed and at a desired time based on the determined linear velocity.

SUMMARY OF THE INVENTION

In the United States, paper weight is expressed as pounds per 500 sheet ream of uncut C-size paper (4× letters size). As such, a cut ream of 20 pound bond letter paper (500 sheets of 8.5×11) would weigh 5 pounds. Because each type of paper has a different "basis size", it is often confusing to talk In terms of the U.S. pound weight system. Instead, it is much more convenient to express paper mass in the ISO (metric) system in which the weight of paper is given in grams per square meter (GSM). For example, 20 pound bond letter stock corresponds to roughly 75 GSM, 24 pound bond letter stock corresponds to roughly 90 GSM, and 28 pound bond letter stock corresponds to roughly 105 GSM. 20 pound Bristol board on the other hand, which has a different basis size, corresponds to roughly 44 GSM. Other known substrates can have substantially higher GSM, some over 300 GSM.

While prior printers, copiers and facsimile machines typically encountered only a handful of different types of substrates, such as A4 or 8.5×11' papers in only a small range of paper weights or densities, today there is a trend toward using more and more diverse varieties of substrates in such systems. Registration systems today thus may be required to accommodate delivery of a wide variety of substrates, each having diverse physical properties.

An exemplary system according to the invention is expected to support substrates between about 50 to 275 GSM (grams/$m^2$). However, the physics involved in transporting such substrates through paper baffle guides results in slightly differing path lengths of the substrate given the same drive control profile for the substrates. That is, it has been found that differing physical properties, such as, for example, substrate thickness, substrate stiffness, substrate mass per unit area, substrate curl, substrate coefficient of friction to the baffles, and the like cause a variance in the actual trajectory, and therefore path length, and therefore arrival time of the substrate given a standardized transport control routine. In other words, for a given baffle configuration between two locations of interest within a paper path, the actual path that a substrate takes, and therefore the path length, can vary with different physical properties of the substrate being moved. In particular, it has been found that these variations are increased when the baffles and other substrate controlling features in the paper path are less constrictive. Because the assumed path length is used to control the registration system, Applicant has found that if there is no compensation for the variations in the actual path length of the substrates being transported, the final registration of the substrate will vary correspondingly as the actual path length deviates from the assumed path length. As printing resolutions are becoming increasingly smaller, system tolerances have become similarly increasingly small. Accordingly, even seemingly small deviations may have objectionable effects on the resultant print system registration.

Because of this, there is a need for a method and system that can compensate the drive profile of the registration system to account for such deviations due to the path length variations of different substrates.

Exemplary systems and methods of the invention achieve this by providing a lookup table or other predefined compensation factor that accounts for differences in one or more physical properties of substrates being transported and registered so that the registration system will reliably register substrates, regardless of such differences in physical properties.

Exemplary systems of the invention may include at least one roll pair formed by a first, driven roll and a second roll defining a nip therebetween that is part of the transport path through which a substrate is passed. A lookup table including a compensation factor for plural different kinds of substrates is prestored, with each compensation factor being based on physical characteristics of the substrate that impact the variations in actual path length of the substrate along the transport path. A particularly relevant compensation factor is a paper path length adjustment value. A substrate determination device determines the substrate being transported. A registration controller operably connected to the first roll controls a drive profile of the first roll. The drive profile is compensated by the compensation factor to adjust the drive profile to correspond to the substrate being transported.

Exemplary methods according to the invention may include: receiving an input selecting one of a variety of different substrate types to be registered by a registration system; accessing a prestored compensation factor corresponding to the selected substrate type that includes at least a paper path length adjustment value based on at least the mass per unit area of the selected substrate type and/or taking into account bending stiffness and curl properties of the substrate; adjusting the drive profile of the roll pair based on the obtained compensation factor; and driving the roll pair using the compensated drive profile.

BRIEF DESCRIPTION OF THE DRAWINGS

The invention will be described with reference to the following drawings, wherein.

DETAILED DESCRIPTION OF PREFERRED EMBODIMENTS

Figure 1:
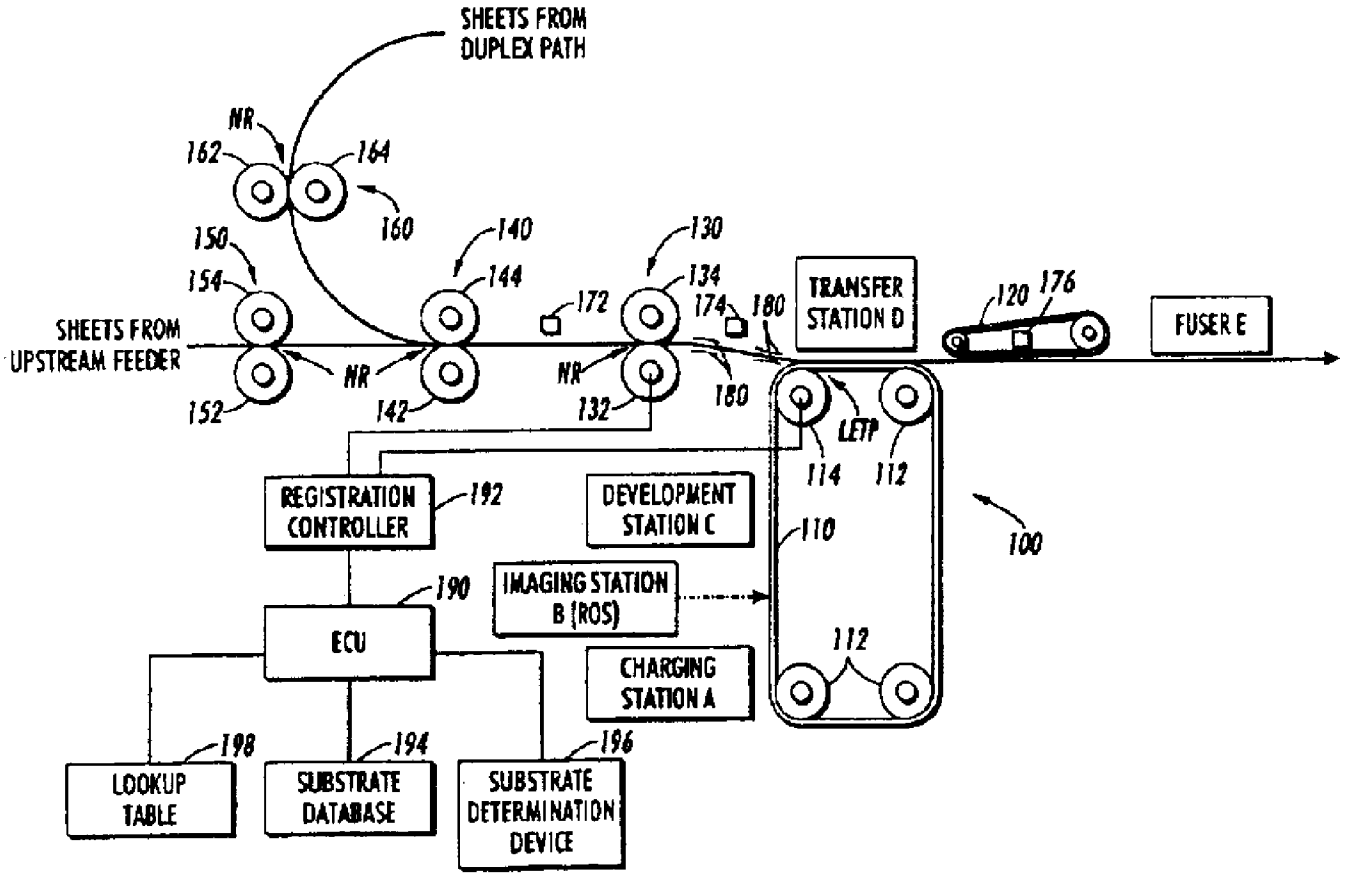
FIG. 1 shows a schematic representation of an exemplary electrophotographic machine incorporating a registration system according to an embodiment of the invention.

For a general understanding of an electrophotographic printer or copying machine in which the features of the invention may be incorporated, reference is made to FIG. 1, which depicts schematically various key components thereof. Although the invention for accurately transporting and registering a broad array of substrate types along a predetermined path is particularly well adapted for use in such a machine, it should be apparent that this embodiment is merely illustrative. Rather, aspects of the invention may be achieved in any registration system in which a broad number of substrate or media types need to be advanced and registered in a precise, accurate manner and the path between the driven nip and the registration zone does not completely constrain the location of the sheet to a single, fixed path in space.

In FIG. 1, electrophotographic printer (copier) 100 employs a conventional photoconductive belt 110 assembly having a photoreceptive surface on which one or more images can be provided. Alternatively, any other conventional or subsequently developed photoreceptive surface may be provided. For example, it is also well known to use a drum having a photoconductive surface instead of the belt.

Belt 110 moves in the direction of the arrow (clockwise) to advance successive portions sequentially through various processing stations disposed about the path of the belt. Belt 110 is advanced by way of a series of rolls 112 and at least one drive roll 114 at a predetermined process speed as known in the art. Initially, a portion of the photoconductive surface of belt 110 passes through a charging station A. Here, one or more corona generating devices charge the photoconductive belt 110 to a relatively high uniform potential. Then, the charged portion is advanced through imaging station B.

At imaging station B, an imaging system such as a raster output scanner (ROS) 120 discharges selectively those portions of the charge corresponding to image portions of the document to be printed or reproduced. This records an electrostatic latent image on the photoconductive surface. ROS 1 20 may be any conventional or subsequently developed scanner, typically including a laser with a rotating polygon mirror block. However, other imaging systems can be employed, for example, an LED write bar or a projection liquid crystal display (LCD) or other electro-optic display.

Thereafter, belt 110 advances the electrostatic latent image recorded thereon to development station C which, for example, could be any conventional or subsequently developed system, such as a magnetic brush development station. At station C, toner particles are attracted to the electrostatic latent image to form a toner powder image on the conductive surface of belt 110. Belt 110 then advances the toner powder image to transfer station D.

At transfer station D, a substrate S, such as a copy sheet of paper, is moved into contact with the toner powder image. Copy sheet S is advanced by a sheet registration system from an upstream supply, such as from an upstream feeder or a duplex path, to a leading edge transfer position LETP close to belt 110 by at least one roll pair, such as exemplary roll pairs 130, 140, 150 and 160 shown. Each roll pair consists of a driven roll (132, 142, 152, 162) backed by an opposing hard idler roll (134, 144, 154. 164) that define a nip region NR therebetween. While only single roll pairs are shown in the side view, there are preferably two roll pairs at each location, one outboard and one inboard in the width direction of the sheets S (transverse to the process direction).

Driven rolls 132, 142, 152, 162 are driven by a drive mechanism, such as a drive motor operably coupled to the roll. Suitable coupling may be through a drive belt, pulley, output shaft, gear or other conventional linkage or coupling mechanism. An exemplary drive mechanism is better described below with reference to FIG. 2.

Substrate transportation is achieved by rotation of the roll pair, which causes corresponding linear movement of the substrate (copy sheet S) through the nip region. The position, timing and velocity of the substrate is controlled by registration controller 192, which receives signals from ECU 190, which is associated with a substrate database 194 and a substrate determination device 196.

Then, transfer is achieved through conventional or subsequently developed devices, such as, for example, a corona generating device that charges the copy sheet to a proper magnitude and polarity so that the copy sheet becomes attracted to and in contact with the toner powder image on the surface of belt 110, at which time the powder toner image is attracted from the belt onto the copy sheet S. After transfer, the corona generating device charges the copy sheet to an opposite polarity to detack the copy sheet from belt 110. Copy sheet S is then advanced to fusing station E, such as by pre-fuser transport conveyor 120.

Copier 100 includes various sensors along the transport path that monitor various movements through the path, such as nip release sensor 172, skew sensor 174 and pre-fuser transport sensor 176 as known in the art.

Fusing station E includes a fuser assembly, which can consist of conventional or subsequently developed fuser elements, such as the shown heated fuser roll and a pressure roll as known in the art. After fusing, the copy sheet S having a fused image thereon may be advanced to an output tray (unshown) or other post-processing device, such as a binder, finisher, collator or stapler.

Figure 2:
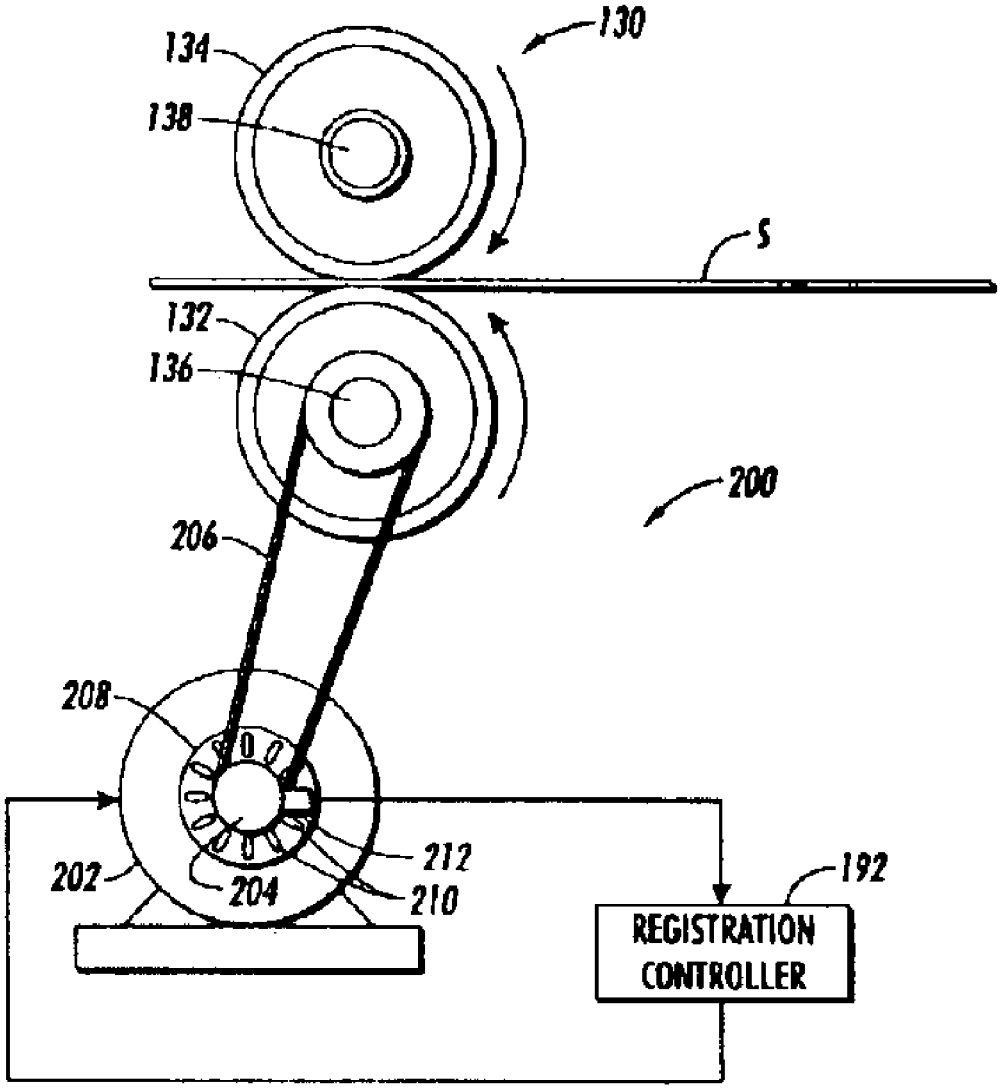
FIG. 2 shows an exemplary driven roll pair according to an embodiment of the invention.

An exemplary drive mechanism 200 for driving a roll pair, such as roll pair 130 is better illustrated in FIG. 2. Drive mechanism 200 includes motor 202 having a shaft 204 operably connected to a corresponding shaft 136 of driven roll 132 through a linkage mechanism, such as the belt 206 shown. Motor 202 is preferably an open-loop stepper motor. However, a feedback-controlled servo motor, controlled by PWM or encoder feedback, or other DC or AC motor may be substituted. An example of an encoder-driven servo motor system can be found in U.S. Pat. No. 5,519,478 to Malachowski, the subject matter of which is incorporated herein by reference in its entirety. In the case of use of an optional servo motor, motor 202 may further be provided with an encoder disk 208 mounted on shaft 204. Such an encoder disk has a series of radially spaced markings 210 that can be sensed by a photoelectric sensor 212.

In the case of an exemplary stepper motor, controller 1 92 provides instructions to motor 202 in the form of stepper motor counts instructing the motor how many turns (steps) to advance. These values or instructions in terms of stepper motor counts are determined in advance. Because there is no feedback in such a system, it is assumed that such advancement takes place. In the case of use of an alternative servo motor, a feedback loop is provided. In particular, as the shaft 204 rotates, disk 208 rotates in unison therewith and the shaft encoder 208, 212 generates an output signal indicative of the rotational speed of the motor 202 in the form of a number of pulses or counts generated in each revolution of the shaft. Accordingly, a period between the beginning and end of each revolution is signified by respective index pulses generated by the reference markings 210 on disk 208. This output is fed to controller 192, which can include its own central processing unit (CPU) or can derive its processing power from ECU 190. Additionally, controller 192 can include RAM, ROM, and I/O devices for interfacing with motor 202. Because idler roll 134 contacts driven roll 132, rotation of driven roll 132 in a direction about shaft 136, such as the counterclockwise direction shown, causes an opposite rotation of idler roll 134 about its shaft 138, such as the clockwise direction shown.

Figure 3:
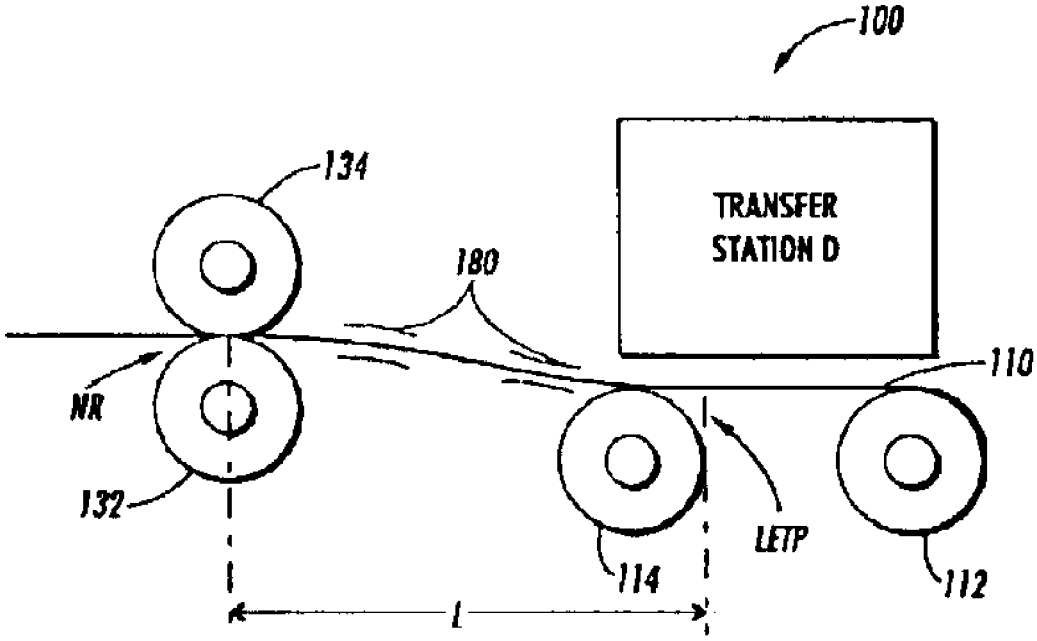
FIG. 3 shows a portion of the transport path of the substrate between a last drive roll pair and a photoreceptor in the electrophotographic machine of FIG. 1.

Referring to FIGS. 1 and 3, in the exemplary copier 100, a nominal distance L along the paper transport path from the registration system drive roll nip NP of roll pair 130 to a point on the photoreceptor where the leading edge of an exemplary transport substrate, such as a 75 GSM paper with no curl, achieves tangency is approximately five inches. The tangency point may be referred to as the leading edge transfer position (LETP). As shown, it is often the case in registration systems that the transport path between the roll pair and the photoreceptor belt is not flat. In such a case, the actual travel path taken by a substrate may not always be the nominal straight line path (distance L) between the two points. Instead, the path may be more or less arcuate as shown owing to the specific bending stiffness of the substrate being transported. While the transport path may be partially constrained by one or more baffles 180 that help guide movements of the substrate through the registration system, such baffles only define the outer boundaries of travel. The actual path taken can be any path defined by the area between the inner and outer baffles 180 as determined by several variables, Including the bending stiffness/flimsiness of the substrate being transported. Because of this, the actual distance traveled may be slightly more or less than the nominal distance.

Because previous registration systems were designed on the assumption that the distance L is invariant with respect to substrate properties, registration errors were introduced. Modeling of the exemplary paper path in the exemplary system, utilizing a proprietary modeling package that is based on non-linear elastica beam theory, shows that over a range of substrate stiffnesses and curls that are expected to be run, the registration varies by approximately a tenth of a millimeter. While this may not sound like much, this range is not an insignificant fraction of the system registration specification and thus it is desired to compensate for this variation so that optimal registration, and therefore overall image quality, reliability, and customer satisfaction of the copier or other device In which the registration system is associated, is achieved.

One suitable method of compensation would be to determine what the arrival time variations would be with different substrates and then advance or retard the registration system timing accordingly to account for the variation. This exemplary method addresses variations in arrival times at transfer zones to accommodate process direction registration variation. However, this method requires an extremely accurate method for measuring the arrival time of the sheet in the LETP in the machine. Typically, this is very difficult to do because of the requirement that the sheet and the image can not be touched or disturbed and because of packaging constraints and the environmental zone in which such a sensing device must be located (which has high electrical fields, frequently elevated temperature levels, and the presence of toner).

An exemplary method of addressing the path length variation while avoiding the potential failure mode mentioned above is achieved by deriving a compensation factor for use in a drive mechanism control profile that adjusts for the expected change in path length as a function of one or more physical properties of a substrate type. One particularly useful embodiment of such is a compensation factor coined as a "paper path length compensation factor." That is, for any given substrate, it is assumed that the differences in actual path length that substrates of varying properties will take can be determined and factored in to the control of the registration drive nip.

One prime correlation factor of the various different substrate physical properties is a sheet's mass per unit area, often calculated in grams/$m^2$ (GSM). It is believed that the operative physical property that most significantly leads to varying path lengths is the bending stiffness of the sheet. Significant bending stiffness testing was conducted on a wide range of substrate GSMs and the correlation between the two properties was found to be reasonably high. Generally, it was found that the higher the substrate GSM, the greater the bending stiffness. Since substrate GSM is a much more readily obtainable parameter than is bending stiffness (in the context of an office or print shop where such a device is likely to be found), it is proposed here to utilize sheet GSM as the key input parameter with which to determine the paper path length compensation factor value.

Figure 8:
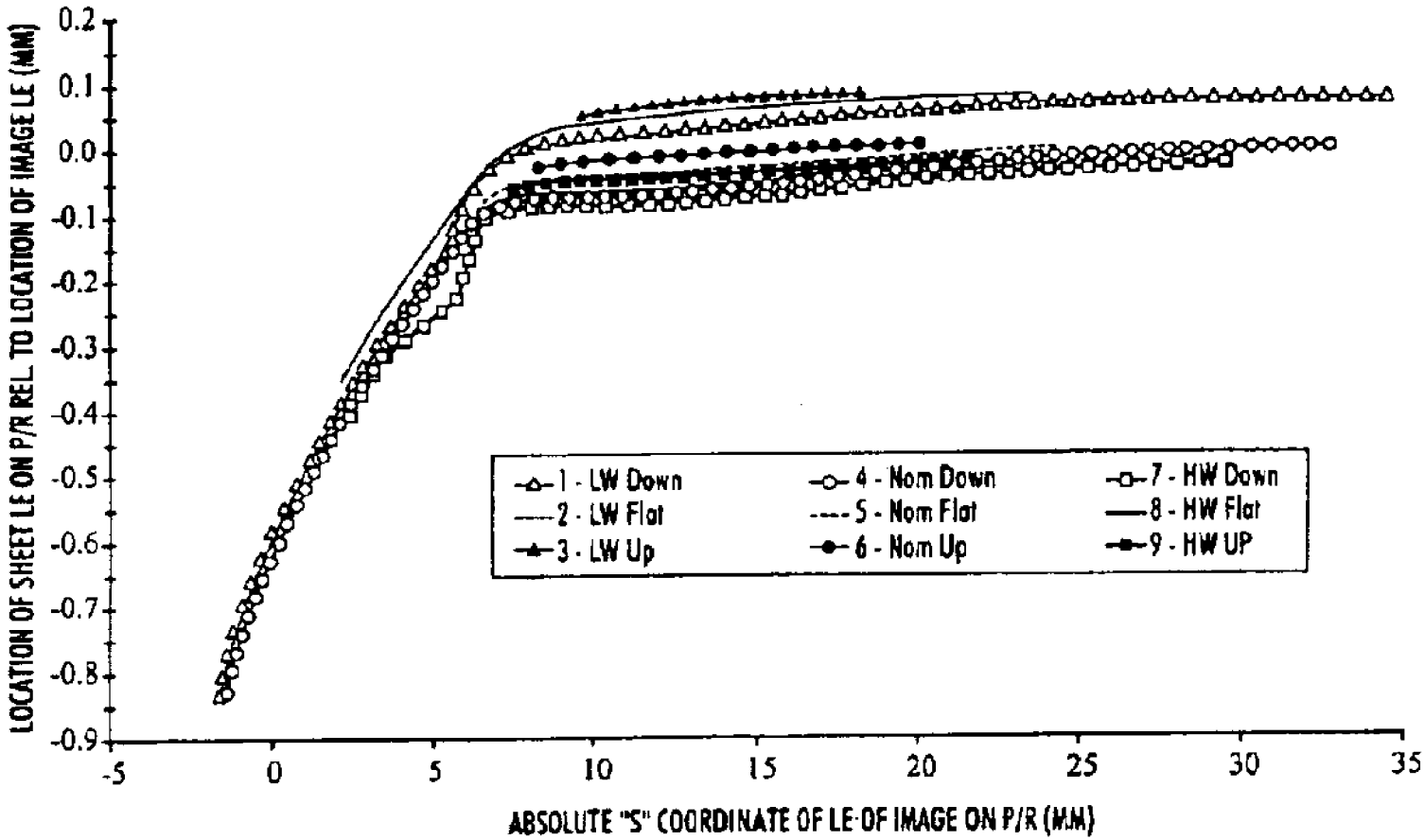
FIG. 8 shows a chart plotting the leading edge of a transported substrate relative to the leading edge of an image on a photoreceptor.

FIG. 8 shows a graph tending to show a correlation between substrate GSM, bending stiffness, and curl, which is believed to correlate to deviations in paper path length. Data in preparation for the graph of FIG. 9 included various weights of paper (lightweight, normal or heavyweight) in terms of GSM oriented with either no paper curl (flat), upward curl or downward curl. Data gathered shows that there is a strong correlation between bending stiffness and GSM. As indicated previously, the general correlation is that as CSM increases, so does bending stiffness. Accordingly, it is believed that GSM can be used as an indicator of bending stiffness, which strongly correlates to deviation in paper travel length.

Two implementations of a copier incorporating a compensated registration system are contemplated. In a first, the copier is intended for a high end user, such as a graphic artist or press operator in a commercial print shop where high-end machines are being used. In such an application, the operator is typically very knowledgeable about the particular copy and print services being used, as well as the various media/substrates desired and used. As such, in this embodiment, an operator is likely knowledgeable enough to appropriately select from a large number of available media/substrate the correct media/substrate being used for a particular job. This information can be entered by way of keyboard, touchscreen or any other input device suitable as substrate determination device 196 in FIG. 1. One suitable exemplary embodiment would display available media from a media database resident in the machine to a display for the operator to review and select from.

A second implementation is for more low-end copiers or copiers intended for general walk-up use. In such an environment, the operators are usually less sophisticated. As such, it may not be reliable or desirable to have such an operator Identify the media/substrate being used from a large number of substrate possibilities. This is particularly the case when physical properties of the substrates, such as GSM, are often unknown to the less-skilled user. As such, for this application, it would be more convenient (and more reliable) for the operator to have a much simpler, reduced subset of media types to distinguish among. For example, it may be convenient to have all media/substrates be categorized into three groups: lightweight substrates, normal or medium substrates, and heavyweight substrates. Such a reduced set of media types makes it easier for a less sophisticated operator to select a substrate type that best represents characteristics of the substrate being used, while still providing a mechanism that fairly reliably compensates for registration of a wide variety of substrates having differing physical properties that effect registration.

Figure 4:
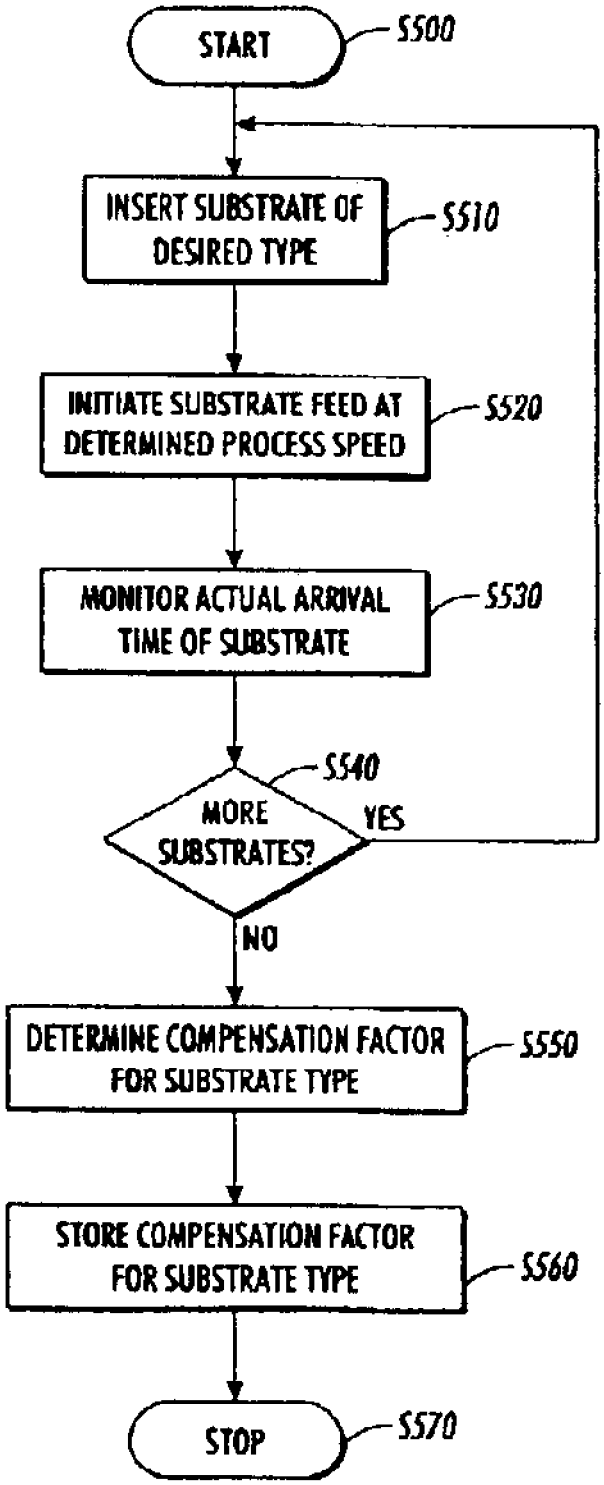
FIG. 4 shows a flowchart of a first exemplary method for measuring and determining a compensation factor according to the invention.

A first exemplary method of obtaining empirically-derived compensation factors for the first implementation (press operators) is shown In FIG. 4. The process preferably uses a test registration system that simulates or is equivalent to one for which compensation factors are to be provided. In this case, the exemplary process uses a registration system similar to that shown in FIG. 1. However, for empirical data acquisition, the test registration system has additional sensors than those typically found on an actual system in use. These additional sensors on the test system are provided to obtain precise measurements of the actual travel path encountered by various substrates through the test registration system, so as to compute or ascertain an appropriate compensation factor. An advantage of this methodology is that once compensation factors are empirically determined, they can be stored for use in a simple, low cost open-loop drive registration system to accommodate changes in substrate types or physical properties without the actual registration system having to have these additional sensors to provide a feedback control.

The process starts at step S500 and advances to step S510 where a first substrate type having first characteristic physical properties is inserted into the registration system for testing. This substrate may be categorized by some individual or collective physical property attribute(s), such as, for example GSM, size, bending stiffness, etc. Then, at step S520 a substrate feed process is initiated, at which time the first substrate is fed at a predetermined process feed speed through the registration system. From step S520, flow advances to step 5530 where the actual total travel distance Is monitored. Additionally, multiple spaced sensors may be provided along the transport path to sense displacement by measuring timings between various locations to give a more displacement velocity profile. Upon completion, flow advances to step S540 where it is determined whether additional substrate types are to be tested. If so, flow returns to step S510. If not, flow advances to step S550 where a compensation factor is determined for each specific substrate type.

One suitable exemplary compensation factor is a path length adjustment value. That is, standard drive profiles assume a fixed path length distance to be traveled and base control parameters, such as the angular velocity and number of rotations of the drive roll to achieve linear transport of the substrate by the fixed distance. However, because of differences in substrate flexure, stiffness, etc., the actual path taken by the substrate may not be a completely linear path and/or it may not be the same as these substrate properties vary sheet-to-sheet. As such, the actual distance traveled may deviate from that contemplated. The path length adjustment value compensates for the deviation between the fixed path length value in the drive profile and the actual measured or modeled travel distance so that an effective drive control can be performed and taken into account in the drive control equations. A suitable adjustment value can be derived from actual empirical test data such as that illustrated in FIG. 8. For instance, in the paper path of the exemplary embodiment it has been determined that for lightweight sheets the actual path length is on the order of 0.08 mm longer than that for nominal weight sheets and for heavyweight sheets the actual path length is on the order of 0.02 mm shorter than for nominal weight sheets.

From Step S550, flow advances to step S560 where the various compensation factors are stored, such as in a lookup table 198 in memory for subsequent retrieval during registration processing. One exemplary embodiment of such a lookup table would be indexed by GSM and would have associated therewith an appropriate compensation factor, such as path length adjustment value. Upon completion, flow advances to step 5570 where the process stops.

Figure 5:
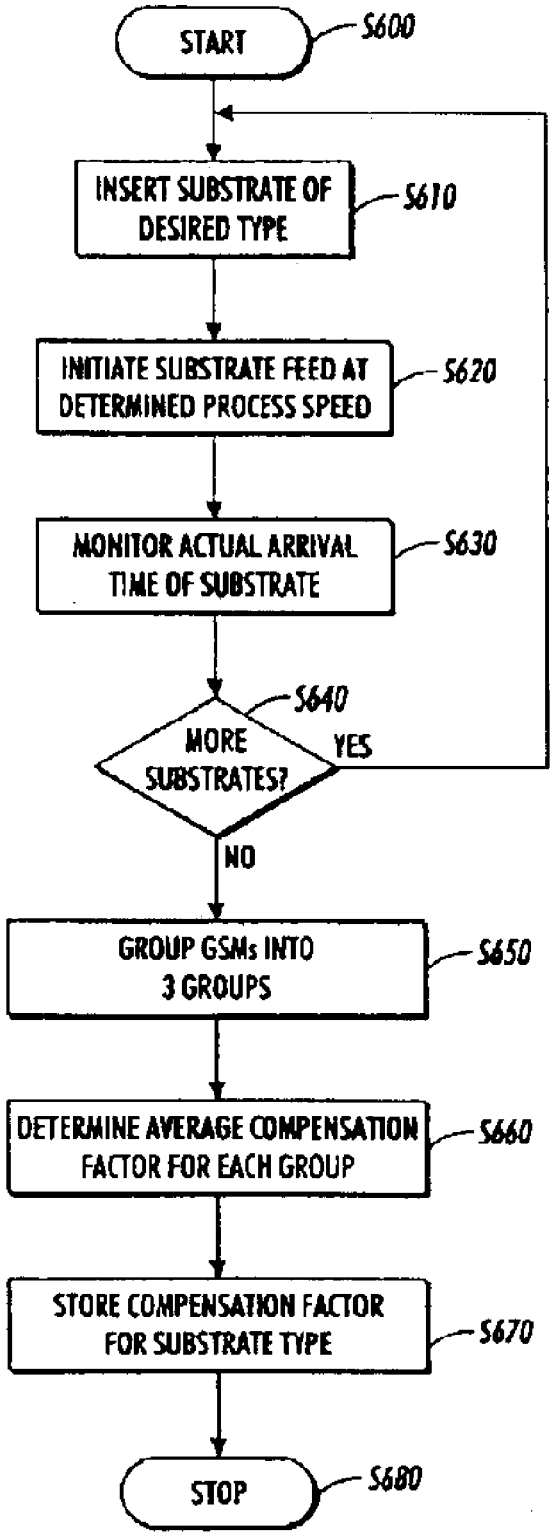
FIG. 5 shows a flowchart of a second exemplary method for measuring and determining a compensation factor according to the invention.

A second exemplary method of obtaining compensation factors for the second implementation (walk-up operators) is shown in FIG. 5. The process uses a registration system the same as or equivalent to one for which compensation factors are to be provided. In this case, the exemplary process uses a registration system similar to that shown in FIG. 1. However, additional sensors are provided to obtain precise measurements of the actual travel path encountered by various substrates through the registration system. The process steps S600 to S640 correspond to steps S500 to S540 in FIG. 4. However, the process differs starting at step 5650 where after completion of testing of all substrates, the overall range of GSMs tested is broken down into a finite number of sub-group ranges, preferably 3 groups. For example, when the GSMs being used range from between 50 to about 275 GSM, the three range sub-groups could be: Group 1 with a range of less than 75 GSM; Group 2 with a range between 75 to 200 GSM; and Group 3 with a range of over 200 GSM. These groupings generally correspond to lightweight, normal and heavyweight substrates, respectively.

Then, at step S660, an average compensation factor is determined for each grouping, with exemplary values similar to those that have been cited earlier. Then, at step S670, the determined compensation factors are stored for each substrate group, such as in a lookup table 198 stored in memory. Then, the process stops at step S680. While the exemplary compensation values are based on a particular system baffle and paper path configuration, it should be apparent that appropriate compensation values may change depending on the particular size, configuration, and properties of the baffle and paper path configuration used in the particular application. However, such values would be similarly determinable from the testing or modeling of various substrates on a machine having such characteristics.

Figure 6:
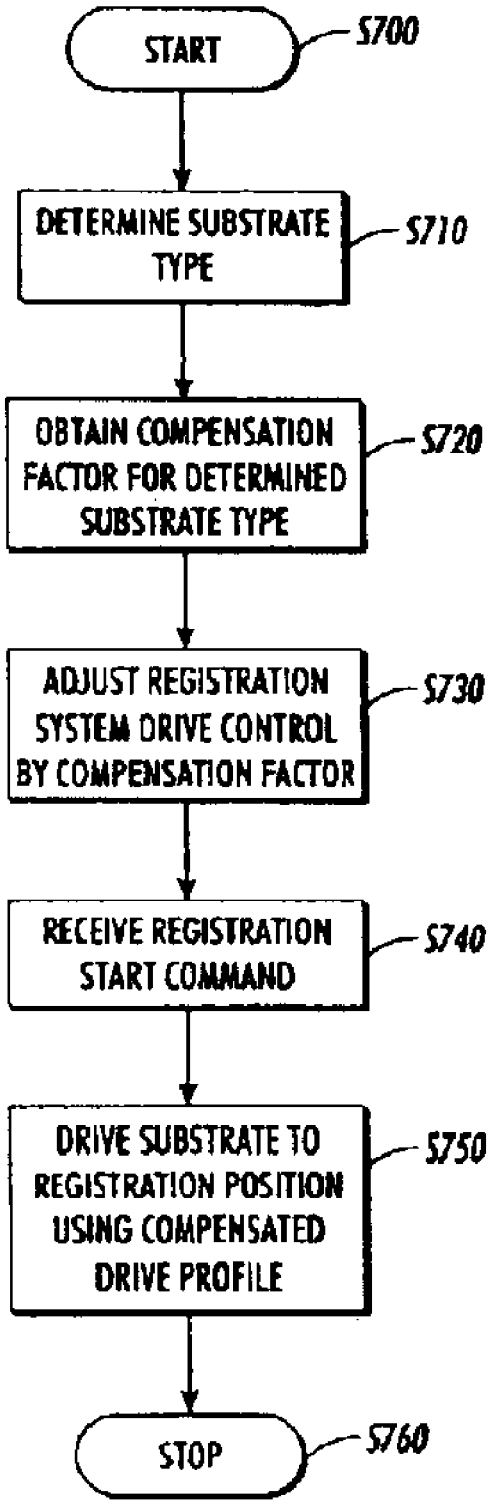
FIG. 6 shows a flowchart of a first exemplary method of registering sheets of various types and physical properties according to the invention.

A first exemplary method of operation of the registration system within a copier or other transport device will be described with respect to FIG. 6. The process starts at step S700 and proceeds to step S710 where a substrate type is determined. In exemplary embodiments the determination is manually made by a system operator. This may be achieved through substrate determination device 196, which may be any known or subsequently developed input device, such as a keyboard, touchscreen, switch, etc. However, it is also possible for the selection to be automatically made by an automated substrate determination device 196. For example, the fuser nip sheet basis weight detection system of U.S. Pat. No. 5,519,478 to Malachowski could be used at an upstream roll pair to detect sheet/substrate basis weight (or GSM) and this information could be used to control operation of downstream roll pairs in the registration system.

From step S710, flow advances to step S720 where a compensation factor is obtained for the determined substrate type. This may be, for example, by retrieving the corresponding factor from lookup table 198 for the particular substrate determined to be present. Alternatively, the compensation factor could be computed by using the determined GSM and a suitable equation based from empirical or theoretical data.

While in exemplary embodiments, it is possible to provide a lookup value with a compensation factor such as a path length adjustment value for each different type or variety of substrate, such an embodiment Is more memory intensive and software complex. An alternative would be to groups two or more substrates into various subgroups. For example, because GSM is a primary determinative physical characteristic, the whole range of GSM can be subdivided into ranges of GSM in which a same lookup value or compensation factor will be used as in the FIG. 4 embodiment. That is, in an exemplary embodiment where the range of GSMs is broken down into groups, each of these groups could have associated therewith a stored compensation factor for that group that corresponds to the average variation of the group. Although this may not be as accurate as use of individual compensation factors for each substrate type, the compensation can be an improvement over no compensation at all.

From step 5720, flow advances to step S730 where the registration drive control is adjusted by the compensation factor. Then, at step S740, a registration start command is received indicating that a substrate is desired to be registered in copier 100. From step S740 flow advances to step S750 where using the compensated drive profile, the drive roll of the registration system is driven to drive the substrate to a desired registration position. Upon completion, flow advances to step S760 where the process stops.

Figure 7:
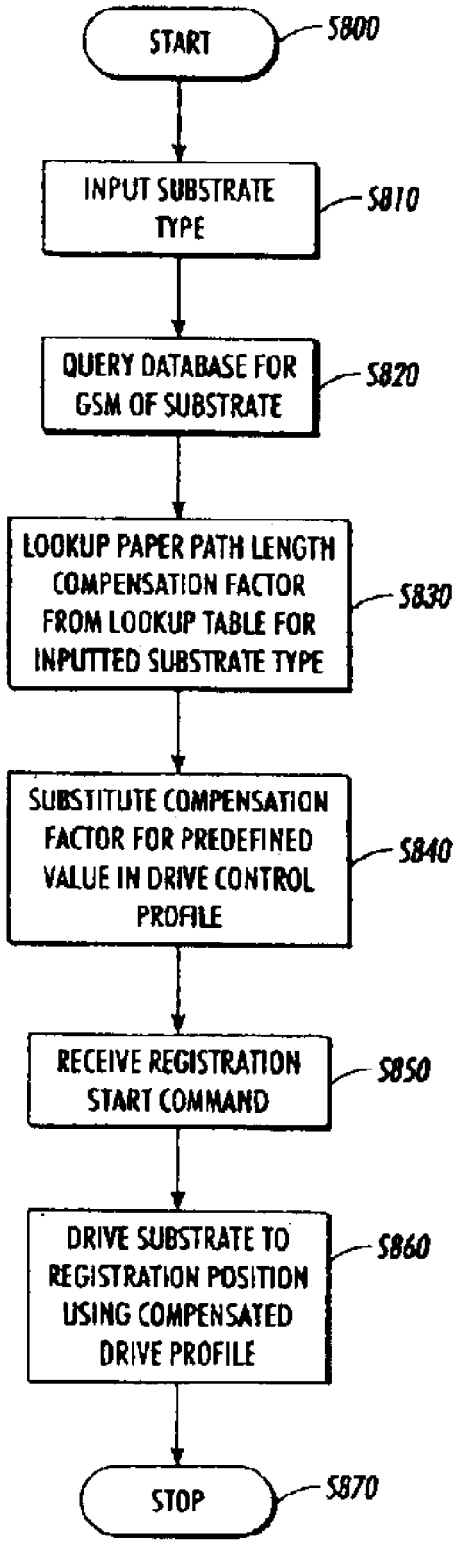
FIG. 7 shows a flowchart of a second exemplary method of registering sheets of various types and physical properties according to the invention.

A more detailed exemplary process is outlined in FIG. 7. The process starts at step S800 and proceeds to step 5810 where a substrate type is input. In exemplary embodiments the determination is manually made by a system operator. This may be achieved through substrate determination device 196, which may be any known or subsequently developed input device, such as a keyboard, touchscreen, switch, etc.

In exemplary embodiments, copier 100 includes a media/substrate database 194 that contains pertinent information for each substrate used in the system. Media database properties may include, for example, GSM, thickness, whether the substrate has holes or not, whether the substrate is coated or not, etc. Each substrate or category of substrates is given a database ID number that is associated with various properties of that media substrate. Of these, a particularly relevant property is the substrate's GSM. In a preferred embodiment, all or at least relevant portions of the database 194 may be displayed to the operator for the operator to select from by way of the input device 196, which can select the appropriate ID number in the media database for a desired substrate.

From step S810, flow advances to step S820 where media database 194 is queried for the corresponding GSM of the selected substrate. Then, flow advances to step S830 where the GSM is used to lookup the corresponding compensation factor, such as paper path length adjustment value. From step S830, flow advances to step S840 where the registration drive control is adjusted by the compensation factor. Then, at step S850, a registration start command is received indicating that a substrate is desired to be registered in copier 100. From step S850 flow advances to step S860 where using the compensated drive profile, the drive roll of the registration system is driven to drive the substrate to a desired registration position. Upon completion, flow advances to step S870 where the process stops.

Thus, with the invention, system hardware or software within registration controller 192 can use the paper path length adjustment value or other compensation factors in its computation of one or more sets of information it sends to firmware to control operation of the registration system and its drive rolls. One such piece of information is the number of revolutions the registration system drive rolls must turn so that the sheet will traverse an appropriate distance from the registration system to a delivery point, such as a transfer/detack zone. This signal is often in the form of stepper motor step counts. By factoring in the paper path length adjustments into the normal equations used, the stepper motor counts can be appropriately adjusted to provide a more accurate registration control.

While this invention has been described in conjunction with various exemplary embodiments, it is to be understood that many alternatives, modifications and variations would be apparent to those skilled in the art. Accordingly, the preferred embodiments of this invention, as set forth above are intended to be illustrative, and not limiting. Various changes can be made without departing from the spirit and scope of this invention.

What is claimed is:

1. A registration system for transporting and delivering various substrates along a transport path to a predetermined destination location at a desired timing, comprising:

at least one roll pair formed by a first, driven roll and a second roll defining a nip therebetween that is part of the transport path through which a substrate is passed;

a lookup table including a compensation factor for plural different kinds of substrates, each compensation factor being based on physical characteristics of the substrate that impact the travel path of the substrate along the transport path;

a substrate determination device that determines the substrate being transported; and a registration controller operably connected to the first roll to control a drive profile of the first roll, wherein the drive profile is compensated by the compensation factor to adjust the drive profile to correspond to the substrate being transported, wherein the compensation factor includes a paper path adjustment value that correlates to a deviation in actual paper path length traveled for the particular selected substrate type.

2. The registration system according to claim 1, wherein the differing characteristics include at least one property selected from the group consisting of substrate thickness, substrate stiffness, mass per unit area, and coefficient of friction.

3. The registration system according to claim 1, wherein a plurality of substantially similar substrates are grouped together and assigned a same compensation factor.

4. The registration system according to claim 3, wherein substrates are grouped into at least categories of light, medium and heavy substrates as determined by mass per unit area of the substrates.

5. The registration system according to claim 1, wherein the compensation factor is based on the mass per unit area of the substrate.

6. The registration system according to claim 1, wherein the substrate determination device includes a user selectable input device.

7. The registration system according to claim 1, further comprising a substrate database of physical properties associated with each of several different substrates.

8. The registration system according to claim 1, wherein the drive control includes a parameter based on an actual nominal distance L between the drive roll pair and a predetermined leading edge transfer position, and the compensation factor provides an empirically or theoretically determined effective paper path length adjustment value that is added to the actual distance L to compensate for the particular substrate being transported.

9. The registration system according to claim 1, wherein the compensation factor adjusts the number of revolutions of the drive roll to deliver the substrate at a desired registration position.

10. The registration system according to claim 1, wherein the registration controller is an open-loop, non-feedback controller and the driven roll is driven by an open-loop stepper motor.

11. A registration system for transporting and delivering various substrates along a transport path to a predetermined destination location at a desired timing, comprising:

at least one roll pair formed by a first, driven roll and a second roll defining a nip therebetween that is part of the transport path through which a substrate is passed;

an input device that selects one of a plurality of different kinds of substrates to be transported;

stored predefined compensation factors for plural different types of substrates, each compensation factor including a paper path length adjustment value that is based on a physical property of the substrate that impacts the travel path taken by the substrate along the transport path, the physical property including at least the mass per unit area of the substrate; and a registration controller operably connected to the first roll to control a drive profile of the first roll, wherein the drive profile is adjusted by the compensation factor to adjust the drive profile to correspond to the substrate being transported.

12. The registration system according to claim 11, wherein a plurality of substrates are grouped together by similarity in mass per unit area and assigned a same compensation factor.

13. The registration system according to claim 12, wherein substrates are grouped into at least categories of light, medium and heavy substrates as determined by mass per unit area of the substrates.

14. The registration system according to claim 11, further comprising a substrate database listing one or more physical properties of each said substrate type.

15. The registration system according to claim 11, wherein the prestored compensation factor is an empirically- or theoretically-derived equation that includes mass per unit area as a variable.

16. A method of registration system control for a registration system having at least one roll pair formed by a first driven roll and a second roll defining a nip therebetween that is part of a transport path through which a substrate is passed, the at least one roll pair being controlled by a registration controller having a predefined drive profile, comprising:

receiving an input selecting one of a variety of different substrate types to be registered by the registration system;

accessing a prestored compensation factor corresponding to the selected substrate type that includes at least a paper path length adjustment value based on at least the mass per unit area of the selected substrate type;

adjusting the drive profile of the roll pair based on the obtained compensation factor; and driving the roll pair using the compensated drive profile.

17. The method of registration system control according to claim 16, wherein the compensation factor adjusts the drive profile to change the actual angular displacement of the drive roll to yield a desired registration position for the substrate.

18. The method of registration system control according to claim 16, wherein the compensation factor adjusts the drive profile to change the number of revolutions the registration system drive roll turns so that a distance traveled by the substrate is adjusted.

19. The method of registration system control according to claim 16, wherein the system includes a substrate database containing physical properties of various substrates, including an identification of mass per unit area, and a lookup table of compensation factors indexed by mass per unit area, further comprising:

locating the substrate type in the substrate database corresponding to the substrate type selected;

querying the substrate database for the mass per unit area of the substrate type selected; and locating the corresponding compensation factor for the queried mass per unit area in the lookup table.

* * * * *